US007938357B2

(12) United States Patent
Johanson et al.

(10) Patent No.: US 7,938,357 B2
(45) Date of Patent: May 10, 2011

(54) DISPENSER FOR ELONGATE MATERIAL

(75) Inventors: James E. Johanson, Old Chatham, NY (US); Fedor Baranov, East Greenbush, NY (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 12/410,600

(22) Filed: Mar. 25, 2009

(65) Prior Publication Data

US 2010/0243784 A1 Sep. 30, 2010

(51) Int. Cl.
*B65H 16/10* (2006.01)

(52) U.S. Cl. ..... 242/588.6; 242/422.4; 242/595; 242/596.8; 242/599.4; 242/614

(58) Field of Classification Search ..... 242/422, 242/422.1, 422.4, 422.9, 614, 614.1, 595, 242/596, 596.7, 596.8, 599, 599.4, 588, 588.3, 242/588.6; 206/414, 415, 416, 408, 403, 206/413

See application file for complete search history.

(56) References Cited

U.S. PATENT DOCUMENTS

| | | | | | |
|---|---|---|---|---|---|
| 1,990,135 | A | | 2/1935 | Sato | 242/588.1 |
| 2,462,776 | A | | 2/1949 | Price | 225/33 |
| 2,822,992 | A | * | 2/1958 | Moulden | 206/394 |
| 3,245,632 | A | * | 4/1966 | Hicks | 242/614 |
| 3,412,847 | A | | 11/1968 | Wise et al. | 242/588.4 |
| 3,614,067 | A | | 10/1971 | Vermette | 242/370 |
| 3,650,389 | A | * | 3/1972 | Mook | 242/614 |
| 3,680,810 | A | | 8/1972 | Jarmalow | 242/171 |
| 3,693,784 | A | | 9/1972 | Holmes | 206/409 |
| 4,244,254 | A | * | 1/1981 | Fish | 242/596.8 |
| 4,771,889 | A | * | 9/1988 | Bauer et al. | 242/588.3 |
| 4,903,833 | A | | 2/1990 | Beery | 206/407 |
| 5,449,070 | A | * | 9/1995 | Broderick | 206/416 |
| 5,529,186 | A | | 6/1996 | Bass | 206/395 |

(Continued)

FOREIGN PATENT DOCUMENTS

FR 524 386 12/1920

(Continued)

OTHER PUBLICATIONS

Reel Options™ Vandor Corporation, Introducing EZ-GO™ Reels with the E-Brake System, http://www.reeloptions.com/exbraket.htm, 3 pages, (Jul. 31, 2008).

(Continued)

*Primary Examiner* — William A Rivera
(74) *Attorney, Agent, or Firm* — Flaster/Greenberg P.C.

(57) ABSTRACT

A device is provided for dispensing a length of elongate material wound on the barrel of a spool. A support is provided for the spool including first and second end plates. The end plates are positioned in a spaced relationship. A support hub extends from each plate and is engaged within an opening in the spool on opposite sides thereof, such that the spool may rotate about the support hub. The support hub includes a peripheral dimension that permits a dynamic, pivoting motion of the spool about the contact with the hub. The support hub normally positions the spool in a radially offset position and engages a friction member formed adjacent the periphery of the flange of the spool. During unwinding, pulling of the end of the elongate material causes the spool to pivot in the direction of the pulling force and away from the friction member. Once the pulling force is removed, the spool pivots about the hub, back into frictional engagement with the friction member.

33 Claims, 12 Drawing Sheets

U.S. PATENT DOCUMENTS

| | | | | |
|---|---|---|---|---|
| 5,634,610 | A | 6/1997 | Walsh | 242/588.3 |
| 5,904,329 | A * | 5/1999 | Kanome et al. | 206/416 |
| 5,967,451 | A | 10/1999 | Radaios | 242/594.2 |
| 6,145,780 | A | 11/2000 | Fontana | 242/588.1 |
| 6,234,421 | B1 | 5/2001 | Cox et al. | |
| 6,523,777 | B2 | 2/2003 | Gaudio | 242/595.1 |
| 6,820,838 | B2 | 11/2004 | Martin et al. | 242/588.1 |
| 7,124,674 | B2 | 10/2006 | Maxey | 83/649 |
| 7,204,452 | B2 * | 4/2007 | Wilkinson et al. | 242/614 |
| 7,341,220 | B2 * | 3/2008 | Katayama | 242/614 |
| 2006/0273217 | A1 | 12/2006 | Wilkinson | |
| 2007/0215502 | A1 | 9/2007 | Babcock et al. | 206/409 |

FOREIGN PATENT DOCUMENTS

| | | |
|---|---|---|
| JP | 2001-120157 | 5/2001 |
| WO | 2009-143919 | 12/2009 |

OTHER PUBLICATIONS

Reel Options™ Vandor Corporation, EZ-Brake Boxed End Stands, http://www.reeloptions.com/newsite/exbraketpage.htm, 2 pages (Mar. 15, 2010).

EP Search Report for EP Patent Application No. 10157546.2 dated Jul. 20, 2010.

* cited by examiner

DISPENSER FOR ELONGATE MATERIAL

FIELD OF THE DEVICE

The present device is for holding and dispensing elongate material, such as cable or wire, from a spool or reel.

BACKGROUND

Various devices are known for holding and dispensing fiber optic cable, wire and other types of elongate material. Examples of these devices include a container, such as a box, with a spool or reel mounted inside. The elongate material is wound on the spool and dispensed by rotation of the spool within the container. In such devices, the spool rotates while the outer container and the support for the spool remain stationary.

In some previous dispensers, the user draws off elongate material from the spool by pulling on the free end of the material. When the user stops pulling, the spool may continue to rotate due to the angular momentum of the rotating spool and material and continue to dispense material from the spool. This "overrunning" of the spool may cause the elongate material to become trapped between the spool and the container, to become tangled with itself or to become wrapped around the spool or its internal supports, creating a material jam. In addition, the overrunning of the spool may result in damage, such as a twist or a kink, to the wire or cable material.

U.S. Pat. No. 7,204,452 discloses a dispenser for elongate material having a support for a spool, with at least one ring on the support encircling the flange of the spool. Means is provided within the ring to create frictional contact with the flange. There is no frictional variation when the pulling force on the elongate material is discontinued. This commonly assigned patent is herein incorporated by reference.

SUMMARY

A dispensing device is provided for dispensing elongate material (such as wire, cable or the like) from a rotationally mounted spool. The spool typically includes a central barrel and one or more flanges positioned at the ends of the barrel, extending radially outward therefrom. An end plate is provided for rotationally supporting the spool. The end plate includes a planar portion having a radial dimension that is greater than the flange of the spool. A support hub extends outwardly from the planar member and fits within the bore of the spool. The spool is rotatably mounted on the hub of the planar member. The support hub is formed to permit pivoting of the spool during unwinding of the elongate material. A friction member or brake is supported on the planar member and positioned radially outward of the support hub. The flange of the spool normally engages the friction member. During unwinding by pulling the end of the elongate material, the spool pivots on the hub and disengages the flange from the friction member to permit free rotation of the spool about its axis. Upon discontinuation of the pulling force, the spool pivots back to its normal position in contact with the friction member.

The spool is dynamically positioned on the support hub to form a first or radially offset position, wherein the flange frictionally engages the friction member. The support hub preferably creates a point of contact on the spool that is offset or behind the center of gravity of the spool. Because of the offset contact point, the spool normally pivots about the support hub back into contact with the friction member. The pulling force on the elongate material causes the spool to pivot forward on the hub. In this second position, the spool is free to rotate. A second contact point is preferably provided by the hub to limit the amount of pivot during the dispensing pull so that the spool pivots only a short distance away from the frictional member.

Further features and advantages will be become apparent by a review of the detailed description and the claims.

BRIEF DESCRIPTION OF THE DRAWINGS

For illustration purposes, there are shown in the drawings various forms that are presently preferred. It being understood, however, that the contemplated device is not limited to the precise arrangements and instrumentalities shown.

DETAILED DESCRIPTION

Figure 1:
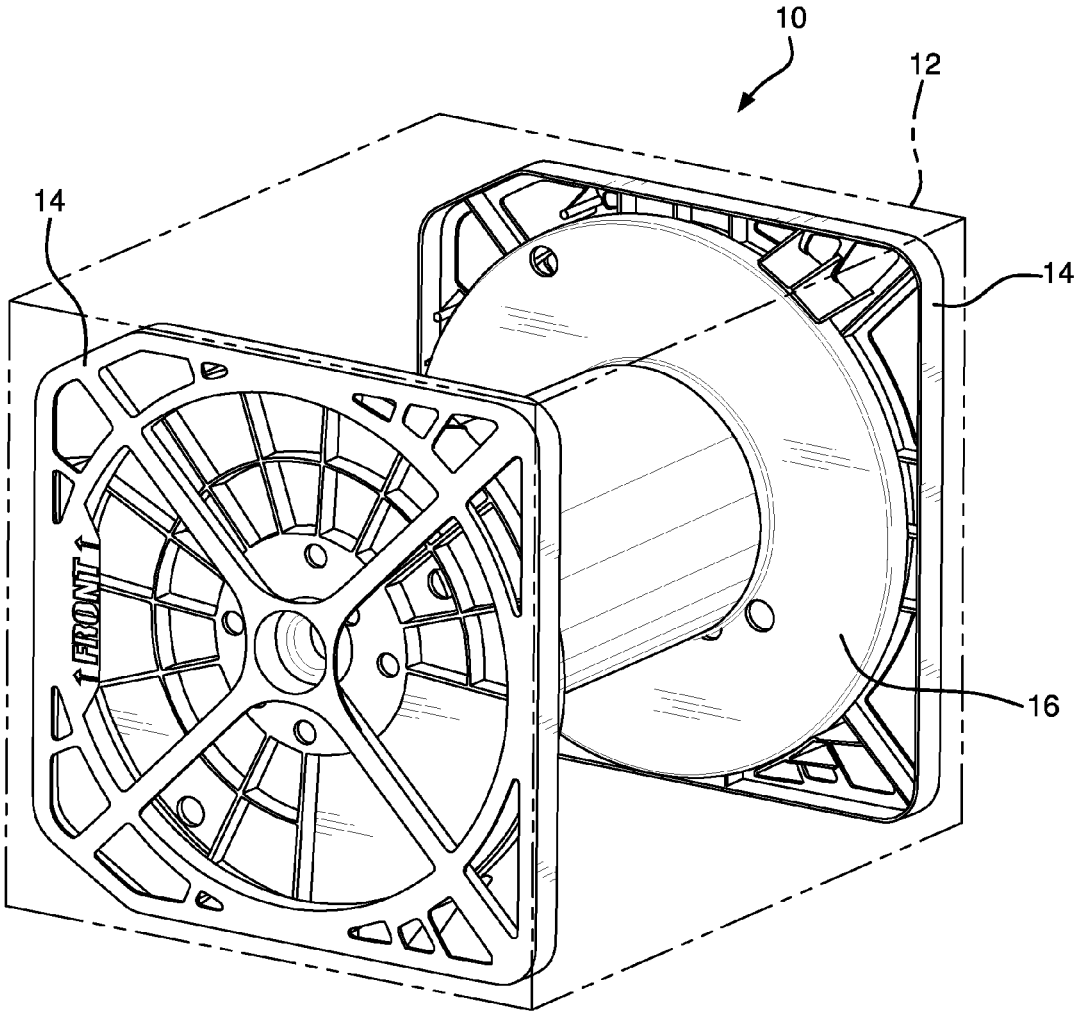
FIG. 1 is a perspective view of a dispensing device including a surrounding container, shown in phantom.

In the drawings, where like elements are identified by like numerals, there is shown an embodiment of a dispenser for storing and dispensing elongate material, such as wire, fiber optic cable or the like. The dispenser is generally identified by the numeral 10 and, as illustrated, comprises a container or box 12 (shown in phantom), a pair of side or end plates 14 and a spool or reel 16 retaining an quantity of elongate material 18 wound thereon (see FIGS. 4 and 5).

Figure 2:
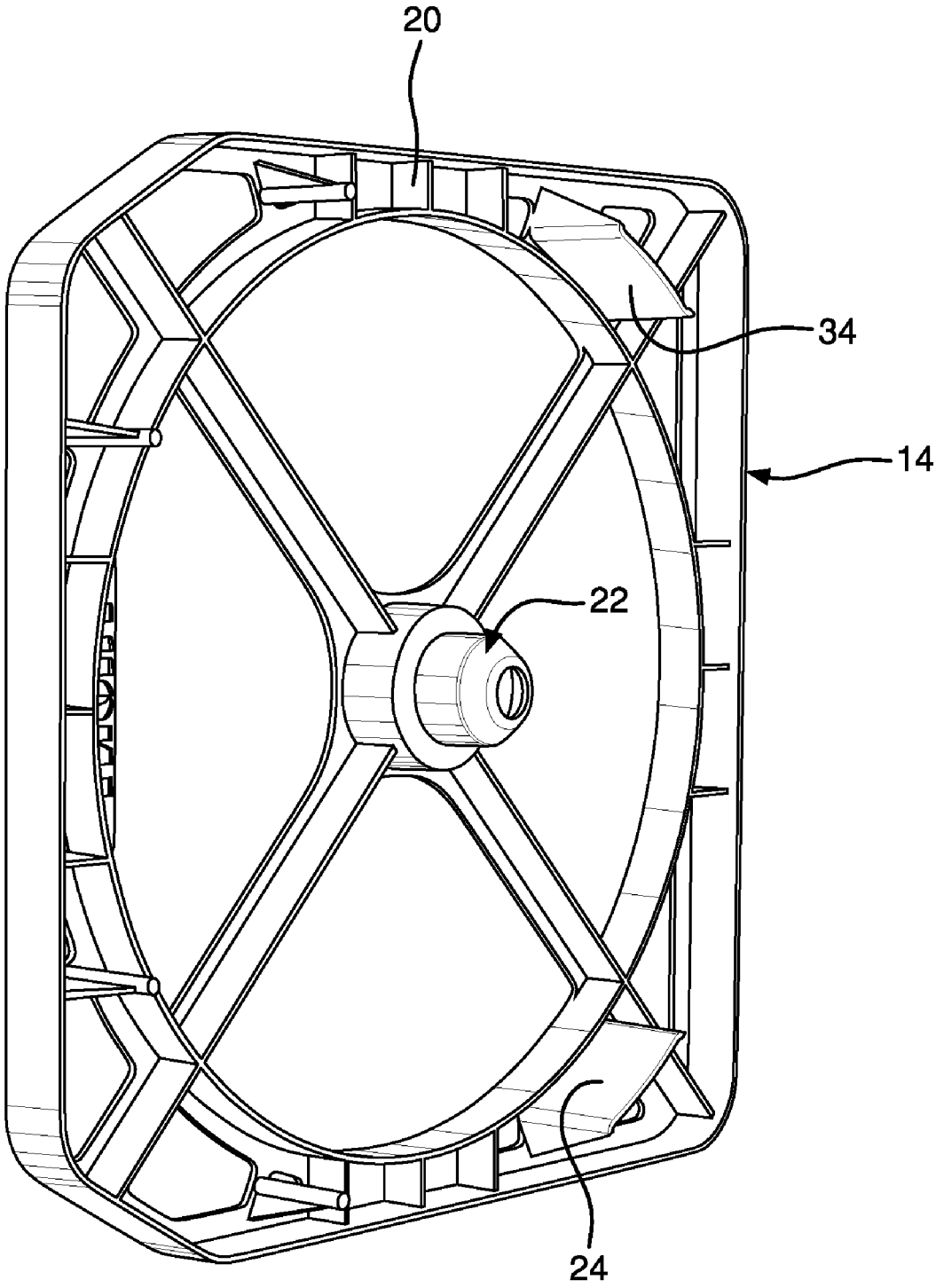
FIG. 2 is a perspective view of an end plate portion of the dispensing device of FIG. 1.
Figure 3:
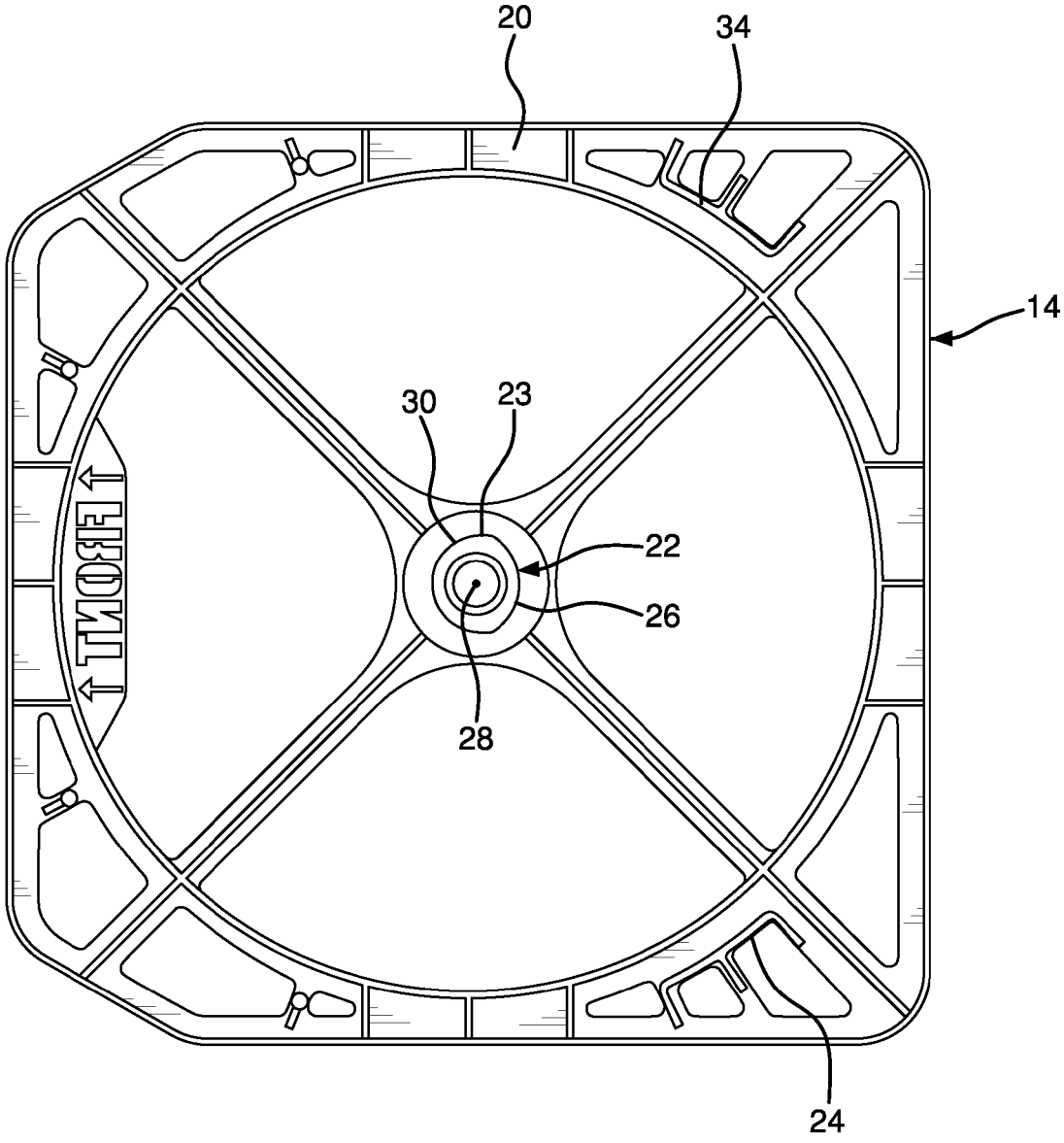
FIG. 3 shows a side elevation of the end plate of FIG. 2.

As more particularly illustrated in FIGS. 2 and 3, the end plates 14 (only one end plate being shown) comprise a planar portion 20, a support hub 22 and a friction member or brake 24. The opposite side end plate 14 (as shown in FIG. 1) is preferably to be identical to the end plate hereafter described, with its structures positioned in mirror images. The planar portion 20 includes a body portion having a peripheral rim and a series of struts formed therein. The body of the planar portion 20 includes considerable open space to reduce the weight of the plate 14 and maintains rigidity by the form of the struts. The support hub 22 is positioned substantially in the center of the plate 14 and projects outwardly from the planar portion 20. In the dispenser 10 (FIG. 1), two end plates 14 are positioned with their respective support hubs 22 projecting inwardly on opposite sides of the spool 16. The spool 16 is provided with a preferably circular opening (see FIGS. 4 and 5) on each end of the barrel and is rotationally supported on the hubs 22.

A friction member or brake 24 is provided radially outward of the support hub 22 on the planar portion 20. The friction member 24 is positioned at a distance from the center of the hub 22 at about the radial dimension of the flange portion of the spool 16. The profile of the engagement surface on the friction member 24 conforms to the curve of the flange on the spool 16.

As shown in FIG. 3, the support hub 22 is non-circular in shape and forms an excentric axle for the spool 16. The hub 22 includes a first surface 26 which is positioned behind (in the direction of the dispensing pull of the elongate material) the center line 28 of the hub 22. A second surface 30 is positioned forward of the center line 28 and faces the front of the end plate 14. The first surface 26 positioned behind the centerline 28 has a larger radius of curvature and is, thus, relatively steeper than the front surface 30. The friction member 24 is positioned behind the center line 28 and below the position of the hub 22.

Figure 4:
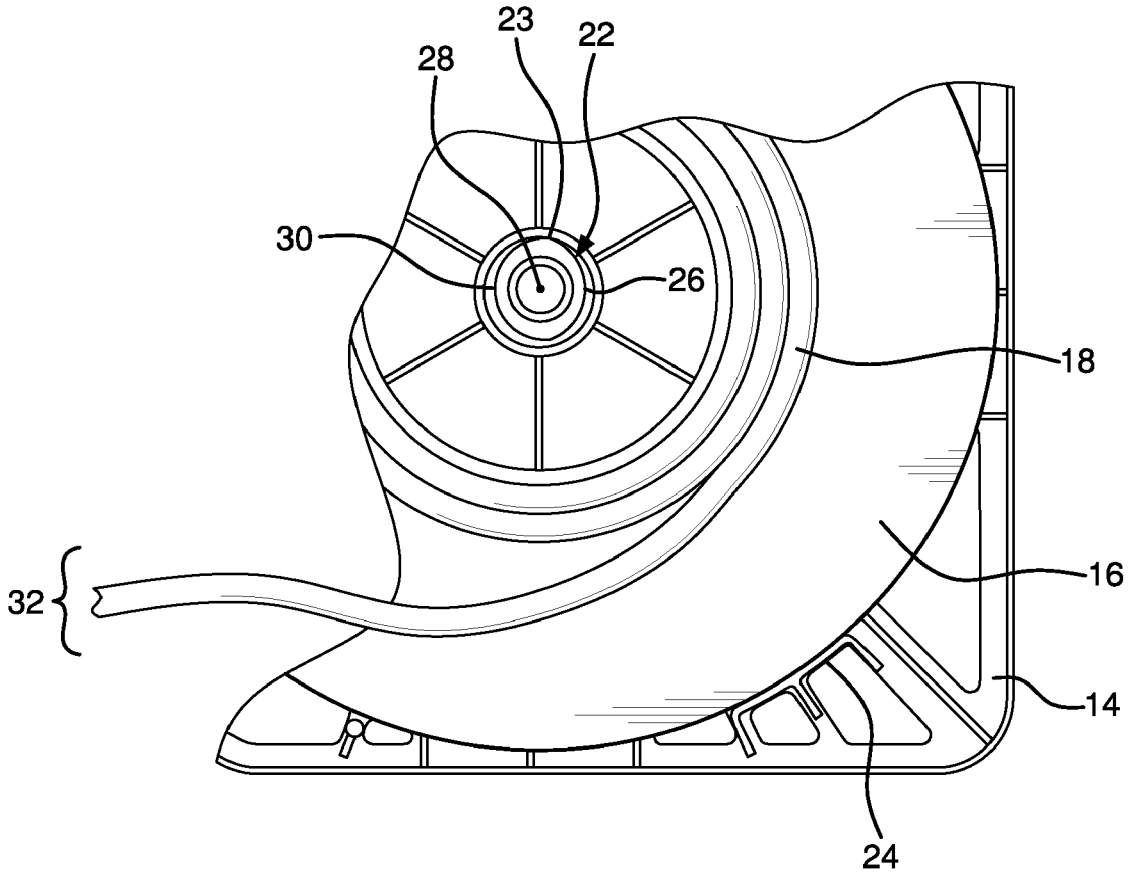
FIG. 4 shows a partial side elevation of the engagement between the end plate and a spool in a normal rest position of the dispenser.
Figure 4A:
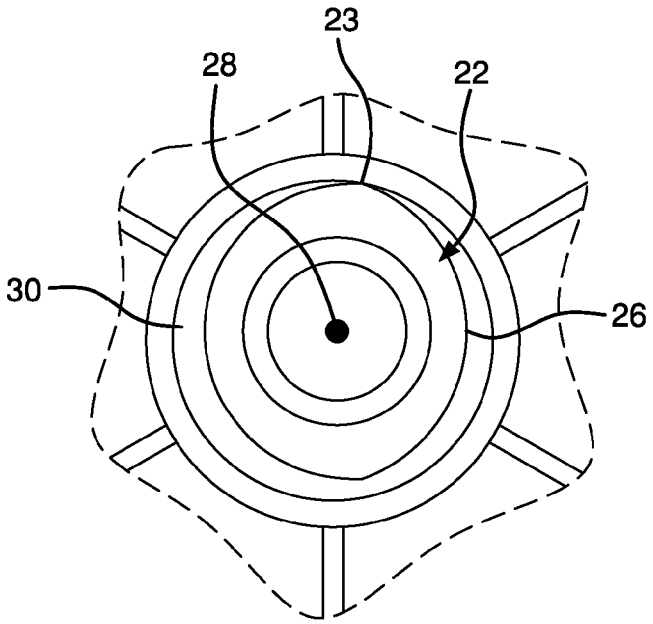
FIG. 4A is an enlarged partial view showing the positioning of the bore of the spool positioned on the hub of the end plate as seen in the rest position of FIG. 4.

As more particularly illustrated in FIG. 4A, the non-circular form of the hub 22 creates a dynamic support for the spool 16. A pivot point 23 is formed at the top of the hub 22. The center of gravity of the spool 16 sitting on the hub 22 is positioned forward of the pivot point 23 of the hub 22. The weight of the spool 16 on the hub 22 is offset from the pivot point of the hub 22 and will normally cause the spool 16 to pivot counter-clockwise (FIG. 3) about the hub 22. This pivoting motion causes the flange of the spool 16 to move rearward and to engage the friction member 24 (FIG. 4).

Figure 5A:
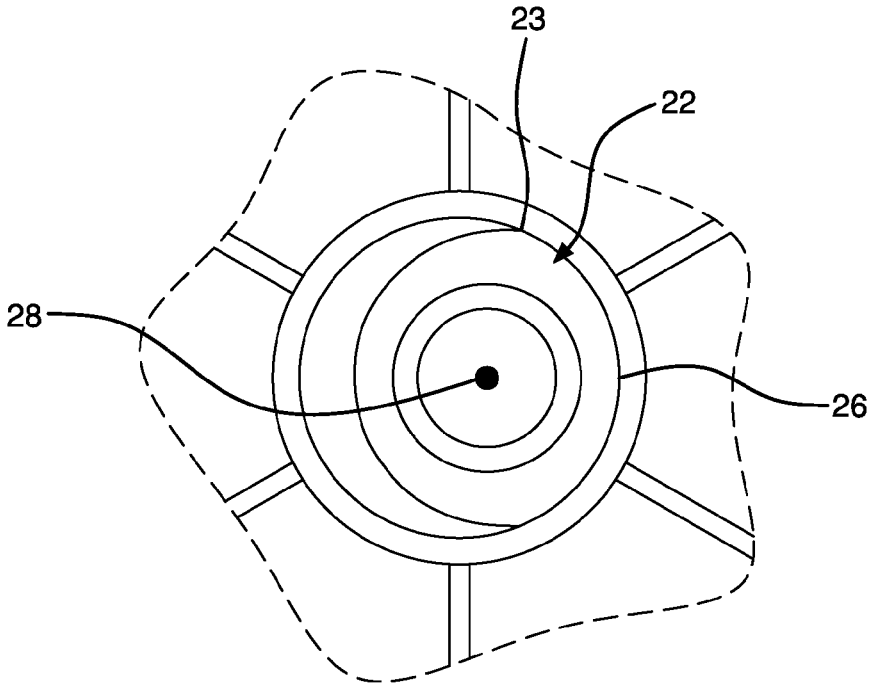
FIG. 5A is an enlarged partial view showing the positioning of the bore of the spool positioned on the hub as seen in the unwinding position of FIG. 5.
Figure 5:
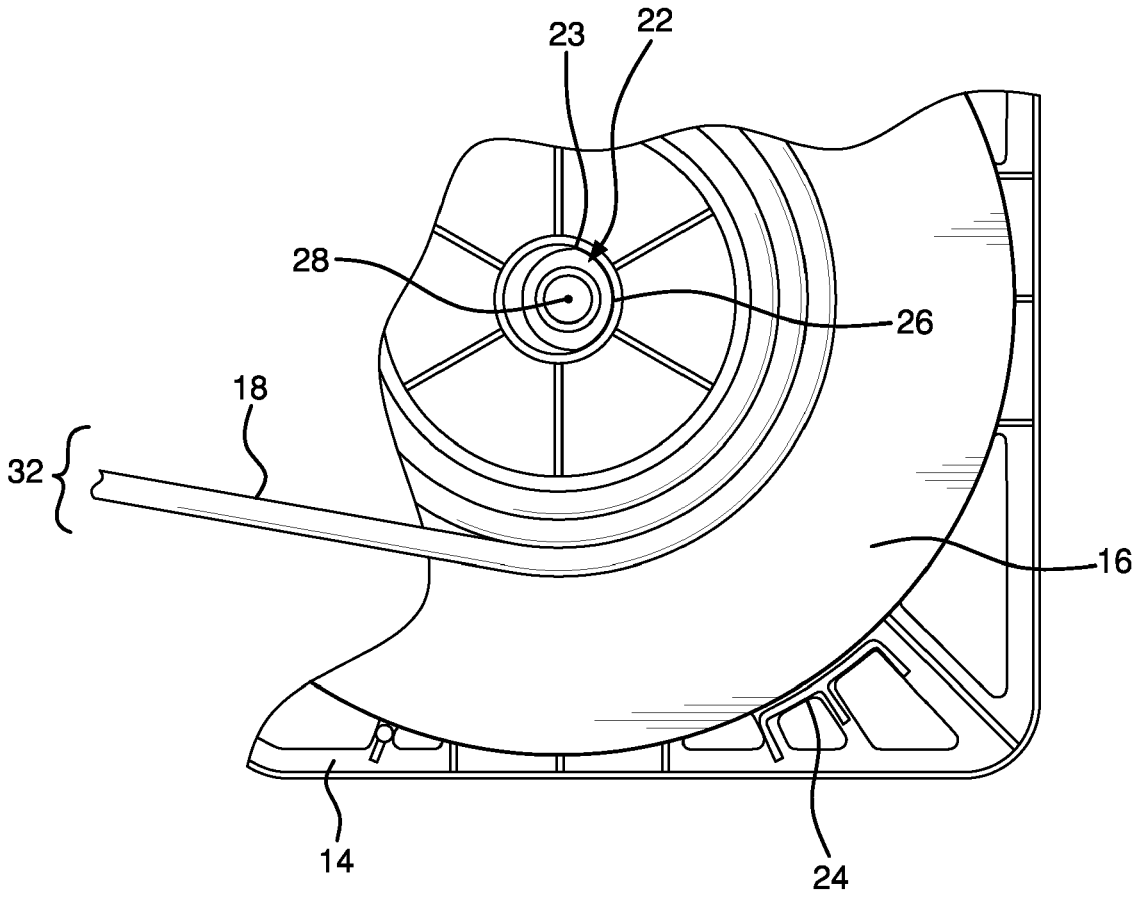
FIG. 5 shows a partial side elevation of the engagement between a spool and the end plate in a second or unwinding position.

As shown in FIG. 5, when a pulling force 32 is applied to the end of the elongate material 18, in the direction of the front of the end plate 14, the spool 16 pivots forward on the hub 22 and the flange moves away from the friction member 24. As more particularly shown in FIG. 5A, the pulling force moves the spool forward with the bore of the spool moving toward the first surface 26 of the support hub 22. Because of the steepness of the first surface 26, the spool 16 pivots towards the front of the end plate 14 a sufficient distance to disengage from the friction member 24.

The dynamic motion of the spool 16 on the hub 22 is illustrated in FIGS. 4 and 5. In FIGS. 4 and 4A, the spool 16 is shown in its normal position without a pulling force applied. Once the pulling force is removed, the center of gravity of the spool 16 attempts to reach equilibrium by pivoting the spool to the rear of the center line 28 of the hub 22. This dynamic motion shifts the spool 16 rearward into a radially offset position and causes the flange of the spool 16 to contact the friction member 24 (FIG. 4).

In FIG. 5, a pulling force is provided on the elongate material 18 in the direction of the front 32 of the end plate 14. The pulling force 32 causes the spool 16 to rotate on the hub 22, such that the center of gravity of the spool 16 is now further forward of the pivot point 23. This pivoting of the spool 16 moves the flange away from the friction member 24 and the inside surface of the opening in the center of the spool 16 is brought into contact with the first surface 26 of the hub 22. In the second or dispensing position, the spool 16 is free to rotate about the hub 22, since the frictional contact between the flange and the friction member 24 has been removed. In the second position, the elongate material 18 is pulled off the rotating spool 16. Once the pulling force 32 on the elongate material 18 is removed, the center of gravity of the spool 16 causes the spool 16 to pivot back on the hub 22 and the spool 16 returns to the position of FIG. 4 with the flange of the spool 16 in contact with the friction member 24.

In operation, there is a momentum created by rotation of the spool 16 during the pulling of the elongate material 18 off the spool 16. The angular momentum results in the spool 16 desiring to continue to rotate after the pulling force on the elongate material 18 is discontinued. However, when the pulling force is removed, the dynamic movement of the spool 16 back into contact with the friction member 24 causes sufficient friction to stop spool rotation and, thus, prevents the overrunning. The friction member or brake is positioned below and behind the support hub. This relative positioning permits the gravitational forces acting on the spool to pivot rearward and to create the contact between the friction member and the flange of the spool. As shown in FIGS. 2 and 3, a second brake 34 is positioned above the support hub 24. This second brake 34 is provided so that a single end plate 14 may serve as the opposite side supports for the spool 16 as shown in FIG. 1. Each end plate 14 as illustrated is substantially symmetrical about its horizontal center line. When the two plates are positioned on opposite sides of the spool, the relatively lower brake on each plate engages the respective flange of the spool. The relatively upper brake 34 on the plate 14 serves this universal molding function, but does not normally engage the flange or normally otherwise function to prevent overrunning of the spool.

Figure 6:
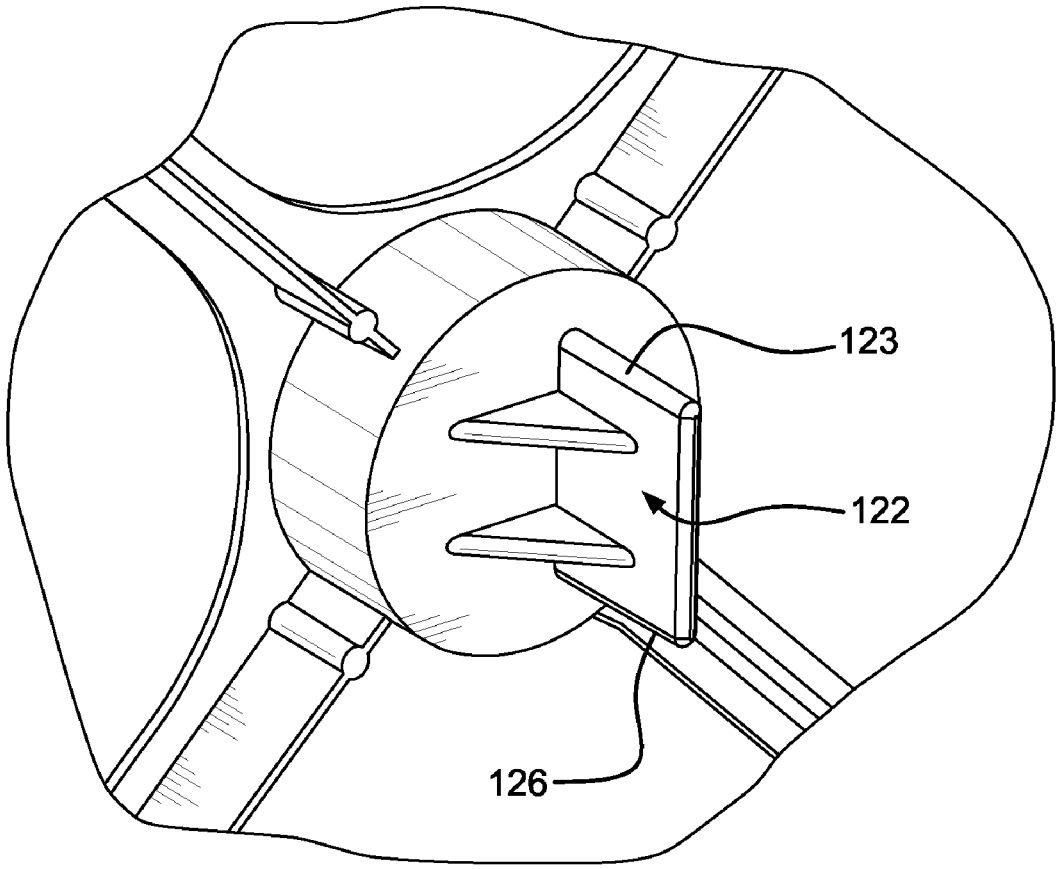
FIG. 6 is a perspective view of an alternate form for the hub portion of the end plate.
Figure 6A:
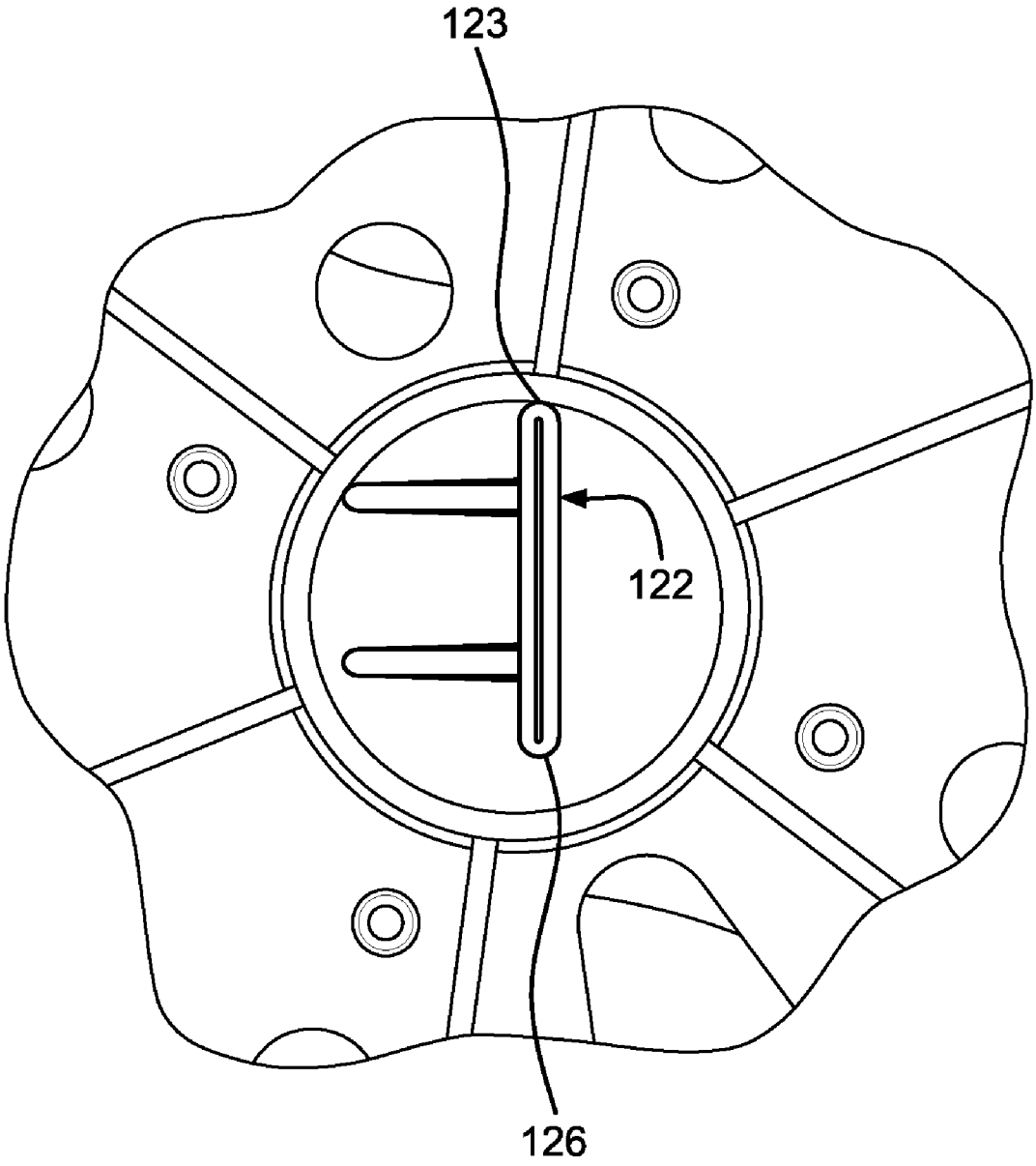
FIG. 6A is an enlarged partial view showing the positioning of the bore of the spool on the alternated hub of FIG. 6 as seen in the rest position.
Figure 6B:
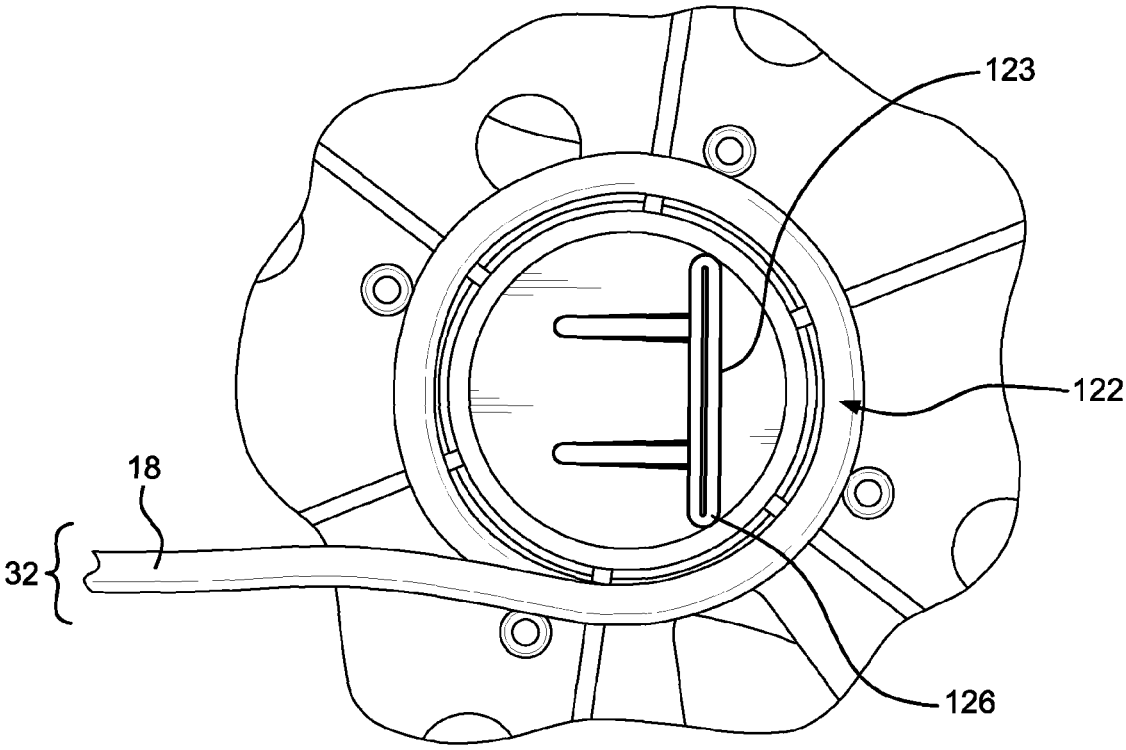
FIG. 6B is an enlarged partial view of the bore of the spool positioned on the hub of FIG. 6 as seen in the unwinding position.
Figure 7:
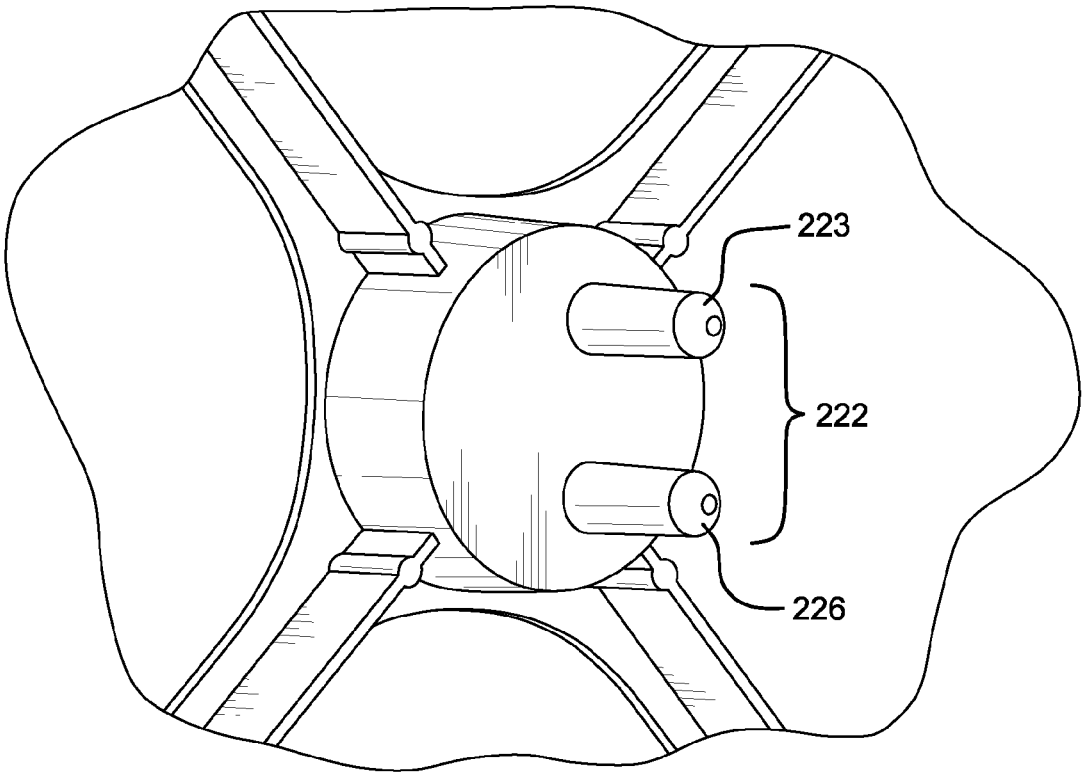
FIG. 7 is a perspective view of a still further alternate form for the hub portion of the end plate.

In FIGS. 6 and 7 there is shown alternate forms of the hub for supporting the spool for rotation thereon. In FIG. 6, a single rib 122 for the hub portion for the bore of the spool. As an alternative, multiple ribs of varying size may similarly support the spool and allow for rotation and the pivoting movement into contact with the brake. The rib 122 is preferably vertically positioned, having a top edge and a bottom edge. The rib 122 is shown to be substantially straight and vertically oriented. However, the rib 122 may be curved or be angled as desired. As shown in FIG. 6A, the bore of the spool is positioned on the rib 122 and in the rest position balanced on the top edge 123. As shown, the spool moves backwards, such that the rim of the flange contacts the brake 24, in the same manner as that shown in FIG. 4. As shown in FIG. 6B, once the pulling force 32 is applied to the elongate material 18 wrapped around the hub of the spool, the bore repositions on the hub plate 122, moving the entire spool forward, away from the brake. The top edge 123 and bottom edge 126 are in contact with the inside surface of the bore. In this unwinding position, the rim of the flange of the spool is positioned away from the brake as in FIG. 5. Once the pulling force 32 on the elongate material is removed, the spool seeks to find a balance position, moving rearward back into contact with the brake (FIG. 4).

Figure 7A:
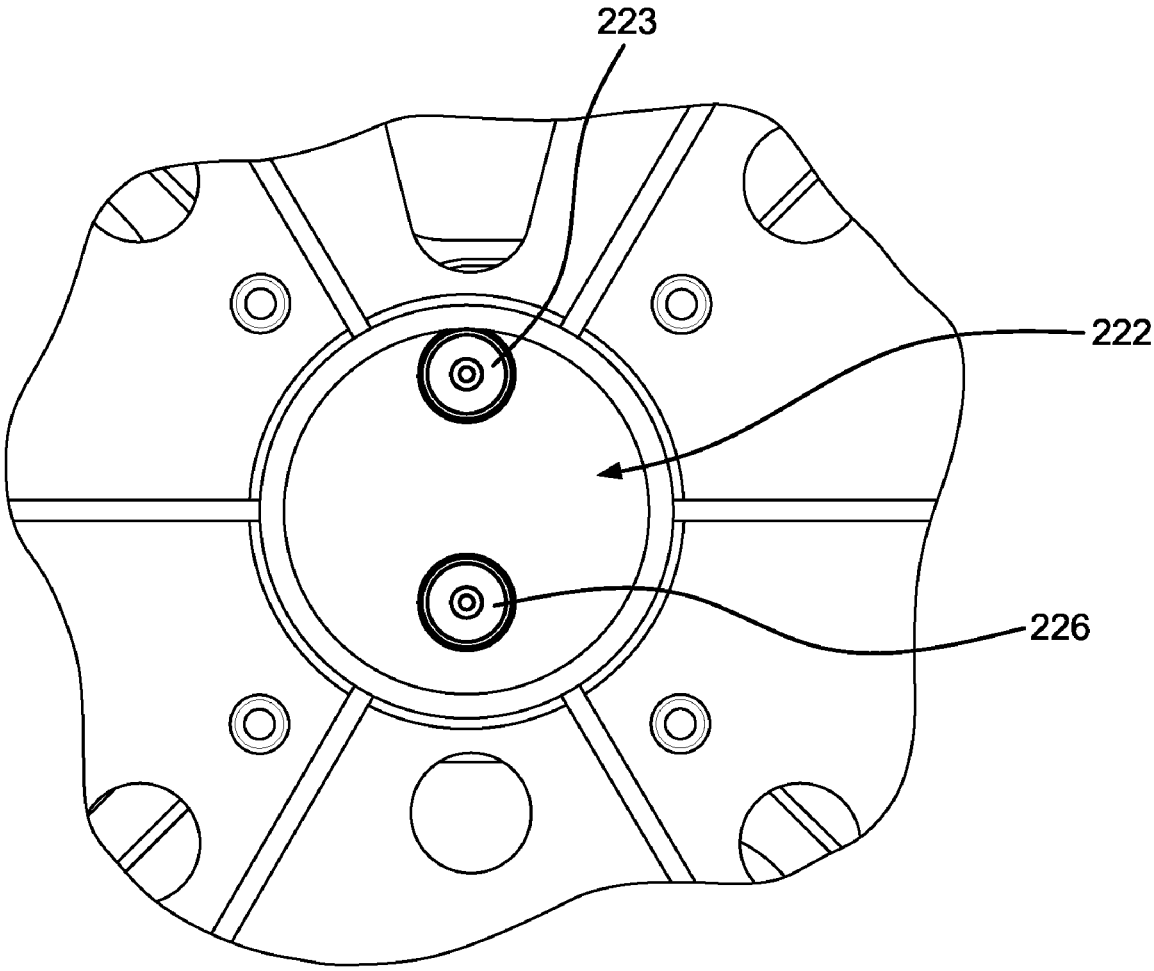
FIG. 7A is an enlarged partial view showing the positioning of the bore of the spool on the alternated hub of FIG. 7 as seen in the rest position.
Figure 7B:
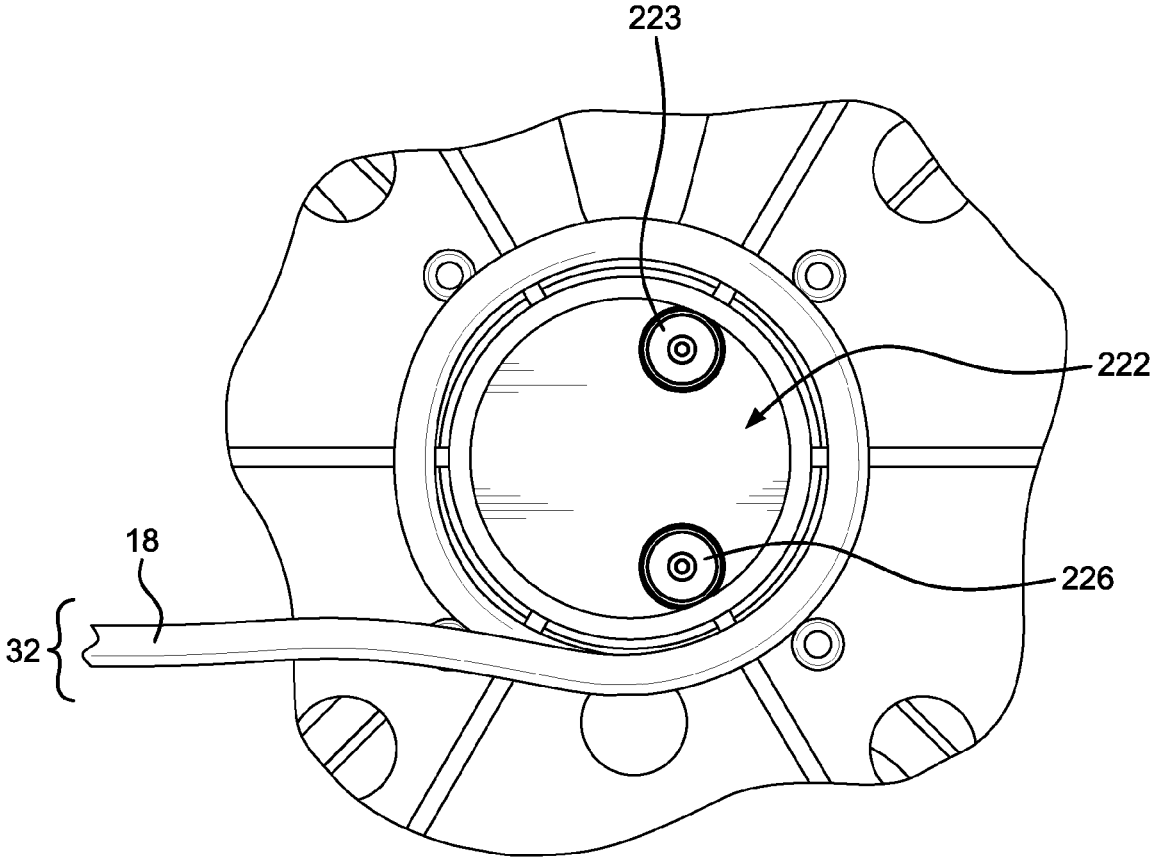
FIG. 7B is an enlarged partial view of the bore of the spool positioned on the hub of FIG. 7 as seen in the unwinding position.

As shown in FIG. 7, the hub 222 is formed by two pins 223, 226 projecting out of the plane of an end plate. The top pin 223 serves as the vertical support for the spool similar to the top edge 23 of the hub 22 of FIGS. 1-5 or the top edge 123 of the plate 122 of FIGS. 6-6B. The second or lower pin 226 is preferably positioned directly below the first pin 223 so that the end plate may be used on both sides of the dispenser and spool. A third pin may also be provided behind the vertical line between the first and second pins, so as to contact the inner surface of the bore of the spool during dispensing, similar to hub surface 26 in the embodiment of FIGS. 1-5. In FIG. 7A, the spool is in the rest position, with the top-most surface of the bore positioned on the first pin 223. The dynamic motion of the spool on the hub 222 places the rim of the flange in contact with the brake surface as shown in FIG. 4. In FIG. 7B, the bore of the spool moves forward in response to a pulling force 32 on the elongate material 18 wound on the hub of the spool. The second pin 226 prevents the spool from rotating too far about the first pin 223 when a pulling force 32 is provided. Excessive forward movement may cause the spool to contact the inner surfaces of the box or at the very least require the end plate to be larger than is otherwise necessary. The dynamic motion of the spool in response to the pulling force 32 in the unwinding condition moves the rim of the flange of the spool away from the contact position with the brake, as shown in FIG. 5. A release of the pulling force 32 on the elongate material results in the spool moving backward and placing the rim of the flange into contact with the brake (FIG. 4).

As shown, two flanges are provided on the spool with an end plate positioned to support each end of the spool. Variations of this structure are possible. For example, a single plate may be provided to support a spool and/or the spool may include only one flange. Other variations of the structures may also be possible. It will be appreciated by those skilled in the art that the present invention may be practiced in various alternative forms and configurations. The previously detailed description of the disclosed embodiment is presented for purposes of clarity and understanding and does not necessarily limit the scope of the invention.

The invention claimed is:

1. A dispensing device comprising:

a spool comprising a central barrel having an axial opening in each end, and a pair of flanges positioned at opposite ends of the barrel and extending radially outward therefrom;

a length of elongate material wound on the barrel and between the flanges, an end portion of the elongate material exposed for initiating unwinding of the material from the spool; and first and second end plates, the end plates positioned in a parallel and spaced relationship, the end plates comprising a planar portion having a peripheral dimension greater than the radial extension of the flanges of the spool, a support extending from the planar portion, one end of the spool rotationally mounted on the support and permitting a pivoting motion of the spool about the support, the support normally supporting the spool in a radially offset position, and a friction member supported on the planar member radially outwardly of the support, the periphery of the flange engaging the friction member in the normal, radially offset position, wherein during unwinding of the elongate material wound on the spool by pulling the end portion of the elongate material and causing a rotation of the spool about the support, the spool pivots on the support in the direction of the pulling of the elongate material and disengages from the friction member to permit free rotation about the support and, when the pulling force is removed, the spool pivots back into the radially offset position in frictional contact with the friction member stopping by friction the rotation of the spool.

2. The apparatus of claim 1 further comprising a box enclosing the spool and the first and second end plates.

3. The apparatus of claim 1 wherein the friction member is in the form of a curved braking surface.

4. The apparatus of claim 1 wherein the friction member is formed on the planar portion of the plates at a position relatively below the centerline of the support.

5. The apparatus of claim 4 wherein the plates are identically formed, each having a second friction member positioned relatively above the centerline of the support when positioned on opposite sides of the spool.

6. The apparatus of claim 1 wherein the planar portion includes a peripheral rim and a series of struts.

7. The apparatus of claim 1 wherein the support includes an asymmetric hub.

8. The apparatus of claim 1 wherein the support includes a vertical plate.

9. The apparatus of claim 1 wherein the support includes a pair of vertically aligned pins.

10. An apparatus comprising:

a spool assembly having first and second flanges, the spool assembly adapted to support and dispense an elongate material wound thereon, first and second end plates positioned on opposite sides of the spool, adjacent the first and second flanges, a support positioned on at least one of the end plates, the support dynamically supporting a respective end of the spool assembly to allow rotation of the spool assembly and to allow for pivoting of the spool assembly on the support between a rest position and an unwinding position to allow for unwinding of the elongate material, and a brake for frictionally engaging at least one of the flanges of the spool assembly, wherein the spool is in engagement with the brake in the rest position and rotating on the support in the unwinding position out of engagement with the brake.

11. The apparatus of claim 10 further comprising a box enclosing the spool assembly and the first and second end plates.

12. The apparatus of claim 10 wherein the friction member is formed on the planar portion of the end plates at a position relatively below the dynamic support.

13. The apparatus of claim 10 wherein the dynamic support is in the form of an asymmetrical hub having an offset pivot on its upper surface.

14. The apparatus of claim 10 wherein the dynamic support is in the form of a vertical plate.

15. The apparatus of claim 10 wherein the dynamic support is comprises a pair of substantially vertically aligned pins.

16. An end plate for rotationally supporting a spool having an elongate material wound thereof, the spool having a central barrel having an axial opening at one end and at least one flange positioned extending radially outward from the barrel, the end plate comprising:

a planar member having a peripheral dimension greater than the at least one flange of the spool;

a support extending outwardly from the planar member, the support having a periphery adapted to fit within the axial opening of the barrel of the spool to rotatably mount the spool on one side of planar member, the periphery of the support normally supporting the spool in an radially offset position and permitting rotating of the spool during unwinding of the elongate material; and a friction member supported on the planar member radially outwardly of the support such that the periphery of the at least one flange frictionally engages the friction member in the radially offset position of the spool on the support, the spool capable of pivoting on the support to a position that is out of engagement with the friction member during unwinding of the elongate material.

17. The end plate of claim 16 wherein the support is in the form of an asymmetrical hub having an offset pivot on its upper surface.

18. The end plate of claim 16 wherein the support is in the form of a vertical plate.

19. The end plate of claim 16 wherein the support is in the form of a pair of substantially vertically aligned pins.

20. An apparatus for retaining and dispensing a length of elongate material comprising:

a spool assembly having first and second flanges and a central barrel extending between the first and second flanges, the spool assembly adapted to support a length of an elongate material wound on the barrel, first and second end plates positioned on opposite sides of the spool, adjacent the first and second flanges, a support positioned on at least one of the end plates, the support dynamically supporting a respective end of the spool assembly to allow for rotation of the spool assembly substantially about a longitudinal spool axis, and a brake for frictionally engaging at least one of the flanges of the spool assembly, the spool pivoting on the support to engage the brake in the resting position and rotating on the support out of engagement with the brake during unwinding of elongate material.

21. An apparatus as in claim 20 wherein at least one of the end plates comprise a planar portion having a peripheral dimension greater than the radial extension of the flanges of the spool.

22. An apparatus as in claim 21 wherein the dynamic support extends from the planar portion of the at least one of the end plates.

23. An apparatus as in claim 20 wherein the structures of the first and second end plates are substantially identical.

24. An apparatus as in claim 20 wherein the dynamic support directs the spool in a radially offset position about the longitudinal spool axis in the resting position.

25. An apparatus as in claim 24 wherein the periphery of the at least one flange is in frictional engagement with the brake in the radially offset resting position.

26. The apparatus as in claim 20 further comprising a box enclosing the spool and the first and second end plates.

27. The apparatus as in claim 20 wherein the brake is in the form of a curved surface formed for engagement with the corresponding flange of the spool.

28. The apparatus as in claim 27 wherein the brake is positioned relatively below the dynamic support.

29. The apparatus as in claim 20 wherein the end plates include first and second brake members positioned relatively below and above the dynamic support.

30. The apparatus as in claim 20 wherein the first and second end plates comprise a peripheral rim and a series of support struts.

31. The apparatus as in claim 20 wherein the dynamic support comprises an asymmetric hub.

32. The apparatus as in claim 20 wherein the dynamic support comprises an elongated rib extending outwardly from the end plate.

33. The apparatus as in claim 20 wherein the dynamic support comprises a pair of vertically aligned pins.

* * * * *